US007819684B2

(12) United States Patent
Fumikura

(10) Patent No.: US 7,819,684 B2
(45) Date of Patent: Oct. 26, 2010

(54) ELECTRICAL CONNECTOR HAVING A POSITIONING PROTRUSION WITH VARIOUS THICKNESS

(75) Inventor: Tadahiro Fumikura, Chiba (JP)

(73) Assignee: Tyco Electronics Japan G.K., Kanagawa-Ken ( * ) Notice: Subject to any disclaimer, the term of this patent is extended or adjusted under 35 U.S.C. 154(b) by 0 days.

(21) Appl. No.: 11/995,860

(22) PCT Filed: Jun. 13, 2006

(86) PCT No.: PCT/JP2006/311827

§ 371 (c)(1),
(2), (4) Date: Mar. 25, 2009

(87) PCT Pub. No.: WO2007/015339

PCT Pub. Date: Feb. 8, 2007

(65) Prior Publication Data

US 2009/0197452 A1 Aug. 6, 2009

(30) Foreign Application Priority Data

Aug. 2, 2005 (JP) ..... 2005-224405

(51) Int. Cl.
*H01R 13/62* (2006.01)

(52) U.S. Cl. ..... 439/326; 439/633

(58) Field of Classification Search ..... 439/326, 439/327, 328, 633
See application file for complete search history.

(56) References Cited

U.S. PATENT DOCUMENTS

| | | | | |
|---|---|---|---|---|
| 5,769,668 | A * | 6/1998 | Tondreault | 439/633 |
| 6,466,452 | B2 | 10/2002 | Yamada et al. | |
| 6,540,539 | B2 | 4/2003 | Yahiro et al. | |
| 7,114,975 | B2 * | 10/2006 | Liao et al. | 439/326 |
| 7,364,467 | B2 * | 4/2008 | Chen et al. | 439/633 |
| 7,445,482 | B2 * | 11/2008 | Ho | 439/326 |

* cited by examiner

*Primary Examiner*—Hae Moon Hyeon
(74) *Attorney, Agent, or Firm*—Barley Snyder LLC

(57) ABSTRACT

An electrical connector for accepting an edge of a circuit board having a notch and a plurality of circuit board electrical contacts disposed on the edge is disclosed. The electrical connector has an insulative housing that accepts the edge of the circuit board. A positioning protrusion is formed on the insulative housing and is at least partially receivable within the notch of the edge of the circuit board. A plurality of contacts are carried by the insulative housing and contact the circuit board electrical contacts. The positioning protrusion has a lower portion that is less than or the same thickness as a width of the notch, an upper portion that is thicker than the width of the notch, and a middle portion connecting the upper portion and lower portion, where the middle portion having a thickness that changes symmetrically.

10 Claims, 10 Drawing Sheets

ELECTRICAL CONNECTOR HAVING A POSITIONING PROTRUSION WITH VARIOUS THICKNESS

CROSS REFERENCE TO RELATED APPLICATION DATA

This application claims the benefit of the earlier filed parent international application number PCT/EP2006/311827 having an international filing date of Jun. 13, 2006 that claims the benefit of Japanese Patent Application No. 2005-224405 having a filing date of Aug. 2, 2005.

FIELD OF THE INVENTION

The present invention relates to an electrical connector that accepts and connects electrically to the edge portion of a circuit board at which electrical contacts are formed, and in particular, to an electrical connector suitable for inserting a memory module in an information-processing device.

BACKGROUND

Electrical connectivity is accomplished by providing a contact-type conductor pattern (electrical contact) at the edge of a circuit board such as a printed circuit board on which electrical components are mounted, and then inserting the circuit board edge containing these electrical contacts directly into an electrical connector. This type of electrical connector for use with printed circuit boards is known as an edge socket connector.

FIG. 7 shows an example of a conventional edge socket connector (hereafter referred to simply as a "socket"). (see FIGS. 9 and 10 of U.S. Pat. No. 6,466,452 B2.) The socket 500 is configured as a zero insertion force (ZIF) socket suitable for attaching a small circuit board 10 on which a semiconductor memory is mounted (memory module) to a motherboard of an information-processing device such as a personal computer.

FIG. 7A is a perspective view showing the socket 500 and the small circuit board 10 to be connected thereto. The socket 500 is provided with an insulative housing 510 having a slot 510*a* that accepts an edge of the small circuit board 10 on which electrical contacts have been mounted, and a plurality of contacts 520 that touch elastically and connect electrically with the electrical contacts 12 of the small circuit board 10 that has been accepted. The socket 500 is mounted onto the motherboard that is not shown by soldering the tine portions of the contacts 520 that are exposed on the underside of the insulative housing 510.

A columnar positioning protrusion 530 is integrally formed at an asymmetric position (here, the position is to the right of center as viewed from the inserted small circuit board 10) along the width (in the lengthwise direction) of the insulative housing 510. This positioning protrusion 530 engages a notch 13 at the edge of the small circuit board 10, and functions to guide the small circuit board 10 to a predetermined position on the slot 510*a*. By providing the positioning protrusion 530 at this asymmetric position, improper insertion of the small circuit board 10 into the slot 510*a* is avoided, and the acceptance position along the width of the small circuit board 10 is regulated such that each electrical contact 12 will connect to the corresponding contact 520.

Elastic support arms 540, each provided with an inward facing tab 540*a* formed at the tip thereof for the purpose of securely holding the small circuit board 10, are disposed in opposing positions on either side of the insulative housing 510.

FIG. 7B is a perspective view showing the state when the small circuit board 10 is inserted into the slot 510*a* of the socket 500 and is held securely by the support arms 540.

When electrically connecting the small circuit board 10 to the socket 500 configured as a ZIF socket, after the edge of the small circuit board 10 on which the electrical contacts are provided is inserted obliquely from above into the slot 510*a* of the socket 500, the other edge is pushed downward, opposing the elasticity of the contacts 520, until the small circuit board 10 is parallel with the motherboard. Then, the side edges of the small circuit board 10 are secured by the pair of support arms 540 provided on each side of the socket 500. Accordingly, without requiring any force for insertion into the slot 510*a*, the small circuit board 10 having one edge accepted into the insulative housing 510 is attached to the socket 500, and an electrically connected state in which each electrical contact 12 elastically touches the contact 520 can be maintained.

However, because there is variance in the width of the positioning protrusion 530 and/or the width of the notch 13 of the small circuit board 10 within the allowable tolerance range, if the positioning protrusion is a member having a simple convex shape, as in the case of the positioning protrusion 530 of the socket 500, the widths may not always match, thereby creating a gap in some cases. For this reason, requests for smaller sizes and higher densities are accompanied by a problem whereby, if the center-to-center spacing (pitch) between the plurality of contacts 520 of the socket 500 becomes small, constant alignment of the center of each electrical contact 12 of the small circuit board 10 with the center of the corresponding contact 520 of the socket 500 becomes difficult to achieve, and positional shifting occurs therebetween.

FIG. 8 shows an example of another conventional socket that has been proposed to solve this problem. (See Patent Document 1, FIG. 1.) This socket 600 has basically the same configuration as that of the above-mentioned conventional socket 500, but differs in that it was devised to enable two small circuit boards 10 to be connected to its sides. In other words, the socket 600 is provided with an insulative housing 610 having two slots 610*a*, each of which accepts one edge of the respective small circuit board 10 provided with electrical contacts, and a plurality of contacts 620 that elastically touch the plurality of electrical contacts 12 on each small circuit board 10, and the socket 600 mounted on a motherboard that is not shown. Elastic support arms 640, each provided with an inward facing tab 640*a* formed at the tip thereof for the purpose of securely holding the small circuit board 10, are disposed in opposing positions on either side of the insulative housing 610. A small circuit board 10 having one edge inserted into the slot 610*a*, is held securely by the tabs 640*a* that engage the concave portions 10*b* at each side surface of the small circuit board 10.

Instead of a columnar positioning protrusion, a positioning protrusion 610*b* (see FIG. 10) having an elastic member 630 disposed at its tip, is integrally formed at an asymmetric position along the width of each slot 610*a* of the insulative housing 610.

FIG. 9 shows details of the elastic member 630 disposed at the tip of the positioning protrusion 610*b*. (See Patent Document 1, FIG. 2.) The elastic member 630 is comprised of a base part 631 into which the positioning protrusion 610*b* integrally formed on each slot 610*a* of the insulative housing 610 is inserted, a pair of support arms 632 that elastically extend and expand outward in a "V-shape" from the base part 631, and, formed on the tip of each support arm 632, a guide part 633 having a curved surface that engages the notch 13 at the edge of the small circuit board 10. The guide parts 633 are devised to have a curved shape so as to surround the tip of the positioning protrusion 610*b* of the insulative housing 610, and therefore, insertion into the notch 13 of the small circuit board 10 is smooth, and the spring force of the support arms 632 opened in a V-shape elastically press-fit the guide parts 633 against the inner wall of the notch 13, thereby guiding the small circuit board 10 to the predetermined position on slot 610*a*. As a result, improper insertion of the small circuit board 10 into the socket 600 is avoided, and the acceptance position of the small circuit board 10 is regulated so that each electrical contact 12 will connect to the corresponding predetermined contact 620.

With the conventional socket 600, the separate elastic member 630 is disposed on the tip of the positioning protrusion 610*b* integrally formed on the insulative housing 610, and accordingly, the guide part 633 expands elastically to constantly press-fit against the inner wall of the notch 13 of the small circuit board 10, thereby enabling a constant matching of the width of the guide part 633 and the width of the notch 13 of the small circuit board 10. As a result, there is no shifting of the acceptance position of the small circuit board 10 due to variation in the width of notch 13 of the small circuit board 10 and the width of the positioning protrusion of the socket 600.

However, as shown in FIG. 10, the pair of support arms 632 of the elastic member 630 do not always expand with left-right symmetry centered about the positioning protrusion 610*b*, and therefore, in response to requests for smaller sizes and higher densities, if the pitch between the plurality of contacts of the socket 600 (pitch of the electrical contacts 12 of the small circuit board 10) is made smaller, constant alignment of the center of each electrical contact 12 of the inserted small circuit board 10 with the center of the corresponding contact 620 of the socket 600 becomes difficult to achieve. Accordingly, the difficulty in regulating the acceptance position of the small circuit board 10 such that the electrical contacts 12 are aligned reliably with the contacts 620 is a problem that continues to exist.

SUMMARY

The present invention, in one embodiment among others, relates to an electrical connector for accepting an edge of a circuit board having a notch and a plurality of circuit board electrical contacts disposed on the edge. The electrical connector has an insulative housing that accepts the edge of the circuit board. A positioning protrusion is formed on the insulative housing and is at least partially receivable within the notch of the edge of the circuit board. A plurality of contacts are carried by the insulative housing and contact the circuit board electrical contacts. The positioning protrusion has a lower portion that is less than or the same thickness as a width of the notch, an upper portion that is thicker than the width of the notch, and a middle portion connecting the upper portion and lower portion, where the middle portion having a thickness that changes symmetrically.

BRIEF DESCRIPTION OF THE DRAWINGS

Prior Art

Prior Art

Prior Art

Prior Art

DETAILED DESCRIPTION OF THE EMBODIMENT(S)

A first embodiment of an electrical connector of the present invention is described below with reference to FIGS. 1 to 5. A small circuit board 10 having the same configuration as in the conventional example can be used, and therefore a duplicate description is omitted here. Moreover, up-down and left-right directions within the drawings are described directly using vertical and horizontal directions.

Figure 1:
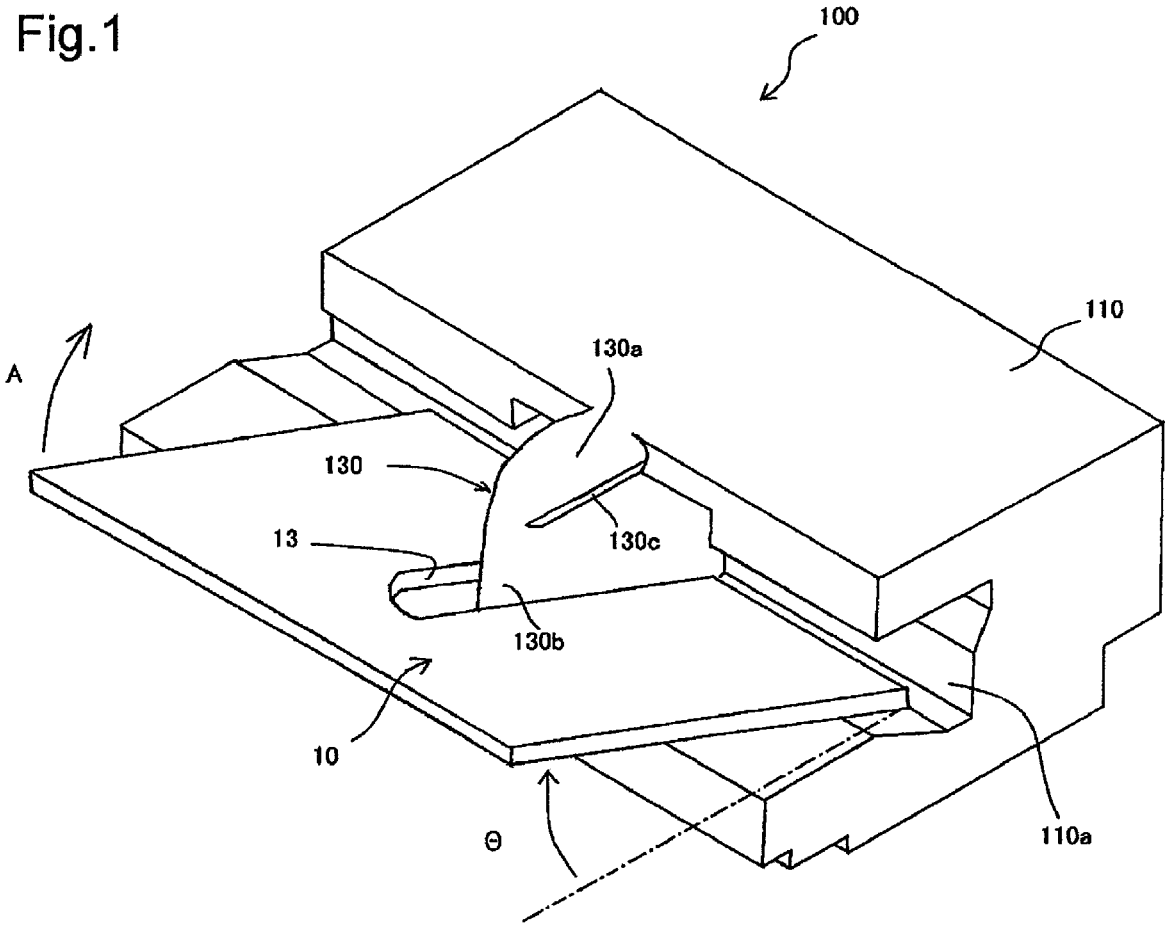
FIG. 1 is a perspective view of the main part of a socket 100 in an embodiment of the electrical connector of the present invention, and shows the engaged state in the case where the width of the notch 13 of the small circuit board 10 and the width of the lower portion 130*b* of the rib-shaped positioning protrusion 130 are approximately equal.
Figure 2:
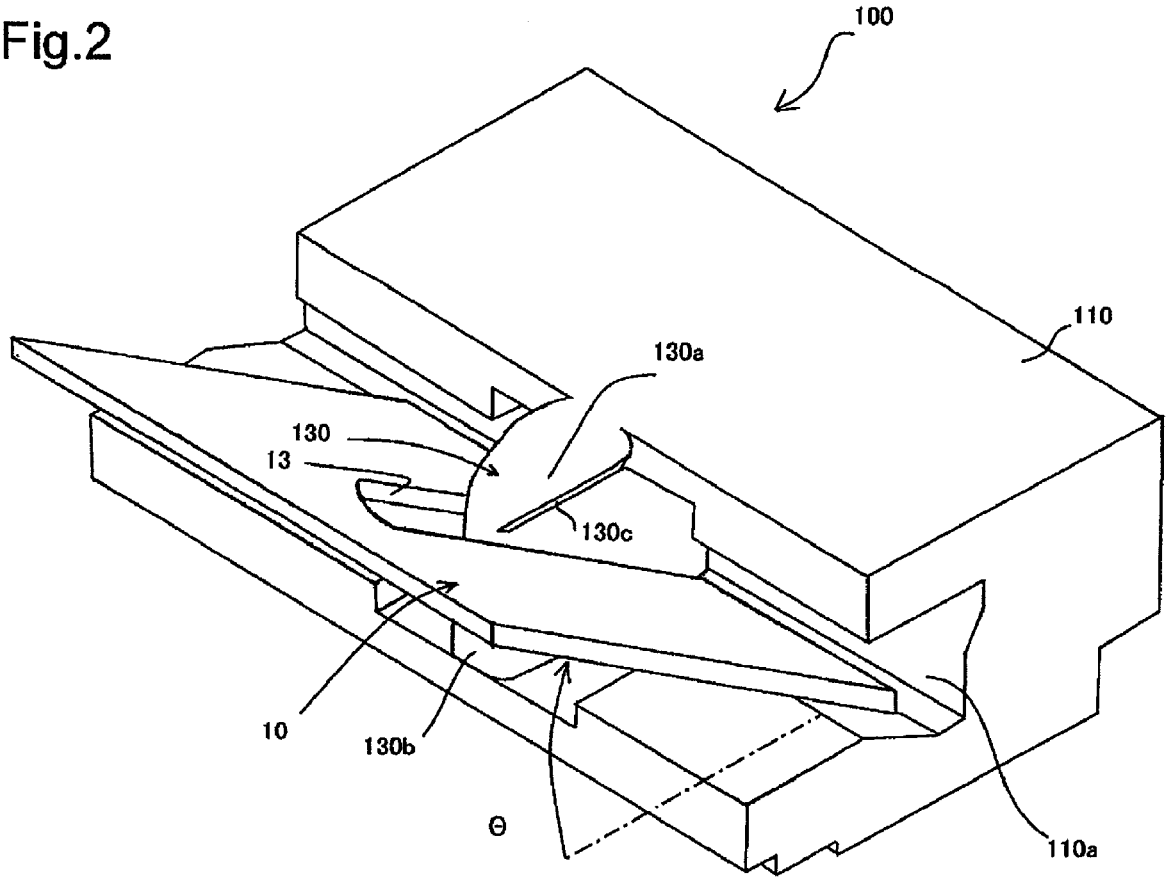
FIG. 2 is a perspective view of the main part of a socket 100 in an embodiment of an electrical connector of the present invention, and shows the engaged state in the case where the width of the notch 13 of the small circuit board 10 is greater than the width of the lower portion 130*b*, and smaller than the maximum width of the upper portion 130*a* of the rib-shaped positioning protrusion 130.

FIGS. 1 and 2 are perspective drawings showing the main parts of a socket that is an embodiment of an electrical connector relating to the present invention. FIGS. 1 and 2 show schematically the state in which the edge of the small circuit board 10 is inserted into the slot.

The socket 100 is a ZIF socket capable of connecting to a small circuit board 10 such as a memory module, and is comprised of an insulative housing 110 having a slot 110*a* that accepts an edge of the small circuit board 10 on which electrical contacts are formed, and a plurality of upper and lower contacts 120, 121 (see FIGS. 4A-4B) that elastically touch each of the electrical contacts mounted on both surfaces of the small circuit board 10. The socket 100 is mounted onto the motherboard of a personal computer or the like by upper and lower soldering tine portions 120*a* and 121*a* of the upper and lower contacts 120, 121 that are exposed on the underside of the insulative housing 110. A boss 110*b* (see FIGS. 4A-4B) provided on the lower part of the insulative housing 110 is for positioning the socket 100 at the predetermined position on the motherboard.

A rib-shaped positioning protrusion 130, protruding towards the insertion of the small circuit board 10, is integrally formed from insulative plastic at an asymmetric position along the width of the slot 110*a* of the insulative housing 110. This positioning protrusion 130 fits into the notch 13 at the edge of the small circuit board 10 inserted into the slot 110*a*, and functions to guide the small circuit board 10 to a predetermined acceptance position. This positioning protrusion 130 prevents incorrect insertion of the small circuit board 10, and regulates the acceptance position along the width of the small circuit board 10 such that each electrical contact of the small circuit board 10 will connect to the predetermined contact of the socket 100. The rib-shaped positioning protrusion 130 has an upper portion 130*a* that is thicker than its lower portion 130*b*. Moreover, the upper portion 130*a* and the lower portion 130*b* are connected by a tapered middle portion 130*c* that symmetrically becomes thicker along the direction from the lower portion 130*b* toward the upper portion 130*a*.

Here, FIG. 1 shows the case in which the width of the notch 13 of the small circuit board 10 is equal to the width of the lower portion 130*b* of the rib-shaped positioning protrusion 130 (or the case in which the width of the notch 13 is slightly larger than the width of the lower portion 130*b* of the rib-shaped positioning protrusion 130, but since that difference is sufficiently smaller than the interval between the small circuit board 10 and the upper contact 120, both widths can be considered equal). In this case, when the lower portion 130*b* of the positioning protrusion 130 is fitted into the notch 13 of the small circuit board 10, regardless of the angle θ of insertion into the slot 110*a* of the socket 100, the acceptance position along the width of the small circuit board 10 is regulated by the lower portion 130*b* of the positioning protrusion 130.

Further, in the above-mentioned case, in the state where one edge is inserted into the slot 110*a*, if the other edge is raised up in the direction indicated by the arrow A in the drawing so that the angle θ of the small circuit board 10 increases, the notch 13 will interfere with the tapered middle portion 130*c*, and ultimately, the middle portion 130*c* that is thicker than the lower portion 130*b* cannot be fitted into the notch 13. Below, in the state where the small circuit board 10 is inserted into the slot 110*a* and the lower portion 130*b* of the positioning protrusion 130 is fitted into the notch 13, the maximum angle of small circuit board 10 is denoted as θ1 (where $\theta \leqq \theta 1$).

On the other hand, FIG. 2 shows the case in which the width of the notch 13 of the small circuit board 10 is larger than the width of the lower portion 130*b* of the rib-shaped positioning protrusion 130, and narrower than the maximum width of the upper portion 130*a*. In this case, a gap occurs between the notch 13 of the small circuit board 10 and the lower portion 130*b* of the positioning protrusion 130, and therefore the acceptance position of the small circuit board 10 inserted into the slot 110*a* cannot be regulated by the lower portion 130*b* of the positioning protrusion 130.

However, even in this case, as will be described below, the socket 100 of the present invention is able to regulate the acceptance position along the width of the small circuit board so that the electrical contacts 12 are aligned reliably with the contacts 620.

Figure 3A:
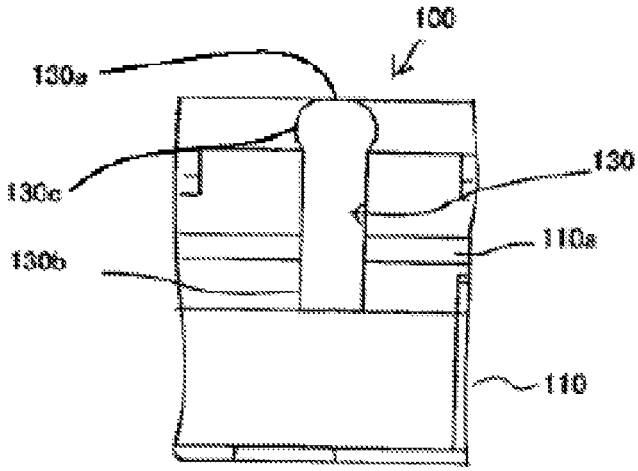
FIG. 3A is a front view, as seen from the small circuit board 10, of the rib-shaped positioning protrusion 130 of the socket 100 in an embodiment of the electrical connector of the present invention in the state in which the small circuit board 10 is not engaged.
Figure 3B:
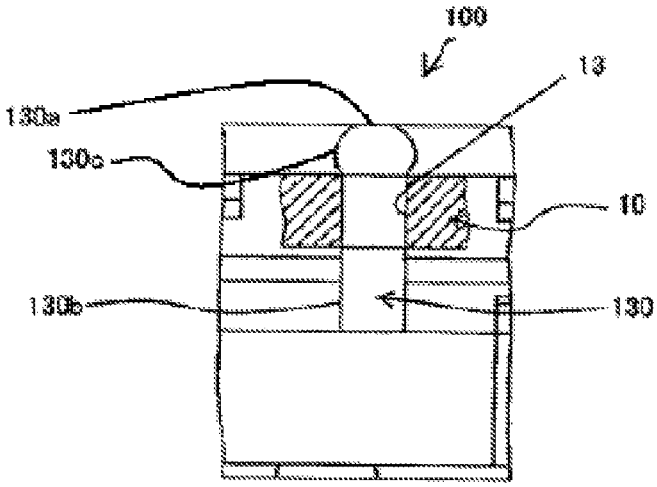
FIG. 3B is a front view, as seen from the small circuit board 10, of the rib-shaped positioning protrusion 130 of the socket 100 in an embodiment of the electrical connector of the present invention in the state in which the small circuit board 10 is positioned by the lower portion 130*b* of the positioning protrusion 130.
Figure 3C:
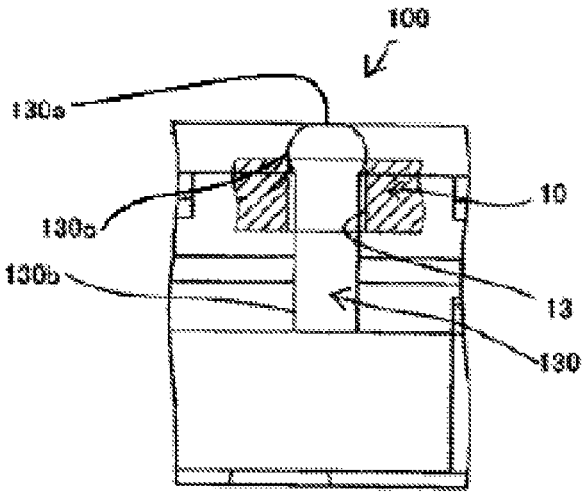
FIG. 3C is a front view, as seen from the small circuit board 10, of the rib-shaped positioning protrusion 130 of the socket 100 in an embodiment of the electrical connector of the present invention in the state in which the small circuit board 10 is positioned by the middle portion 130*c* of the positioning protrusion 130.

FIGS. 3A-3C are front views of the rib-shaped positioning protrusion 130 of the socket 100 as seen from the small circuit board 10 inserted into the slot 110*a*.

As shown in FIG. 3A, the positioning protrusion 130 is comprised of a lower portion 130*b* having a uniform thickness, an upper portion 130*a* that is thicker than the lower portion 130*b*, and a middle portion 130*c* disposed therebetween and having a tapered shape of a continuously changing thickness with left-right symmetry. In the case where the width of the notch 13 of the small circuit board 10 is approximately equal to the thickness of the lower portion 130*b* of the positioning protrusion 130, as shown in FIG. 3B, the position of the small circuit board 10 is determined by fitting the lower portion 130*b* of the positioning protrusion 130 into the notch 13. On the other hand, in the case where the width of the notch 13 of the small circuit board 10 is larger than the thickness of the lower portion 130*b* of the positioning protrusion 130, and smaller than the thickness of the upper portion 130*a*, as shown in FIG. 3C, the position of the small circuit board 10 is determined by fitting the middle portion 130*c* of the positioning protrusion 130 into the notch 13. In other words, the configuration is such that, by manipulating the small circuit board 10 having one edge inserted into the slot 110*a* so that the angle θ becomes larger than the above-mentioned θ1, even in the case where the width of the notch 13 is larger than the width of the lower portion 130*b* of the positioning protrusion 130, the width of the notch 13 will surely match the thickness at a portion of the tapered middle portion 130*c*.

Next, the sequence for guiding the small circuit board 10 inserted in the socket 100 to the predetermined acceptance position is described with reference to FIGS. 4A-4B and 5 for the case in which the width of the notch 13 of the small circuit board 10 is larger than the thickness of the lower portion 130*b* of the positioning protrusion 130, and smaller than the thickness of upper portion 130*a*.

Figure 4A:
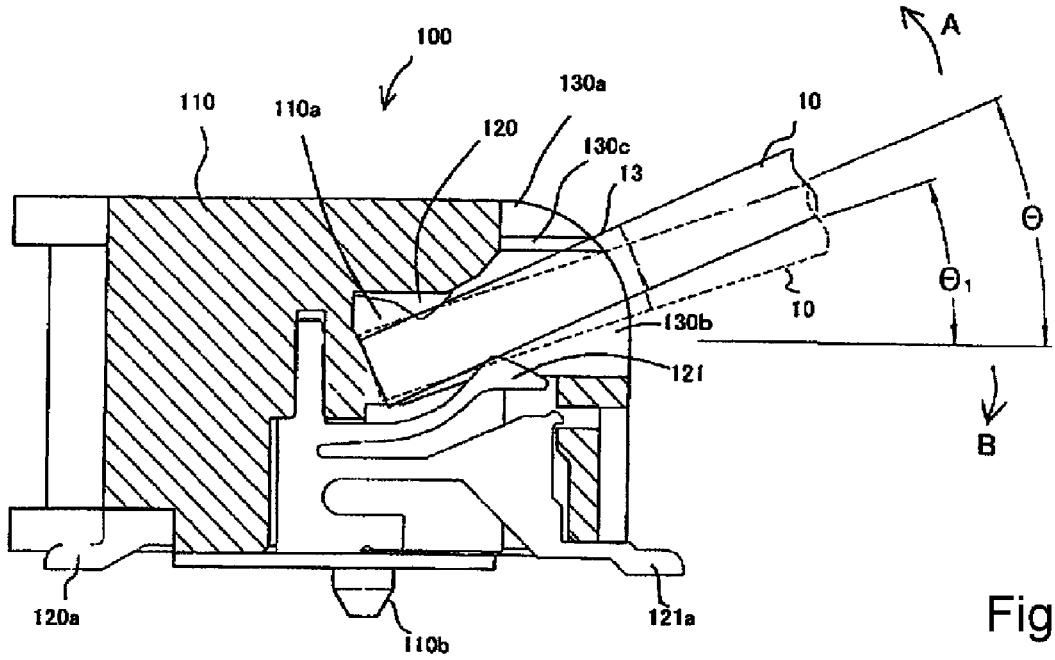
FIG. 4A shows a cross-section of the socket 100 in an embodiment of the electrical connector of the present invention where the cross-section is taken at the location where the lower contact 121 at which an elastic arm is located is visible at the bottom side of the inserted small circuit board 10.
Figure 4B:
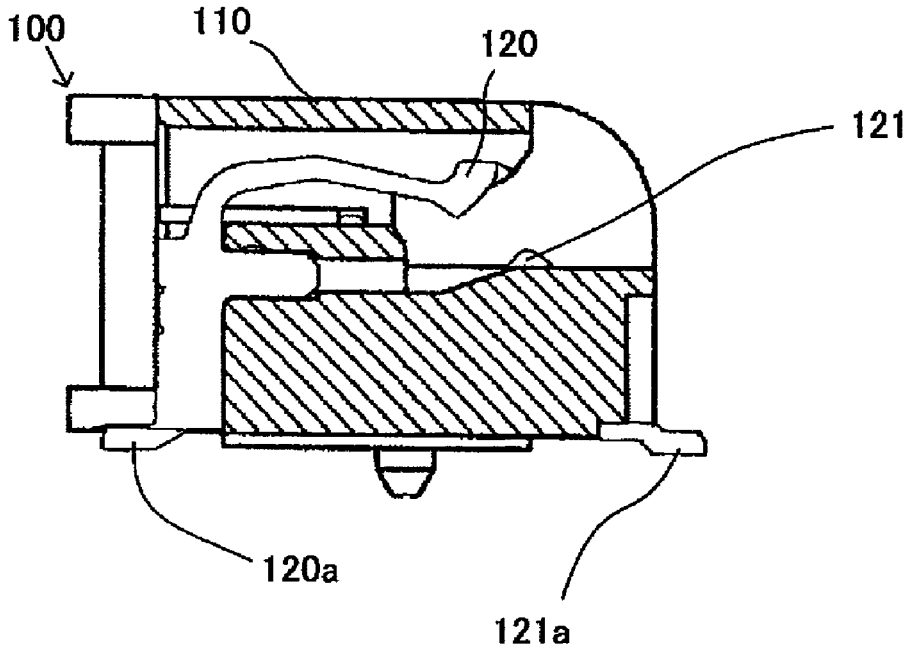
FIG. 4B shows a cross-section of the socket 100 in an embodiment of the electrical connector of the present invention where the cross-section is taken at the location where the upper contact 120 at which an elastic arm is located becomes visible at the top side of the inserted small circuit board 10.
Figure 5:
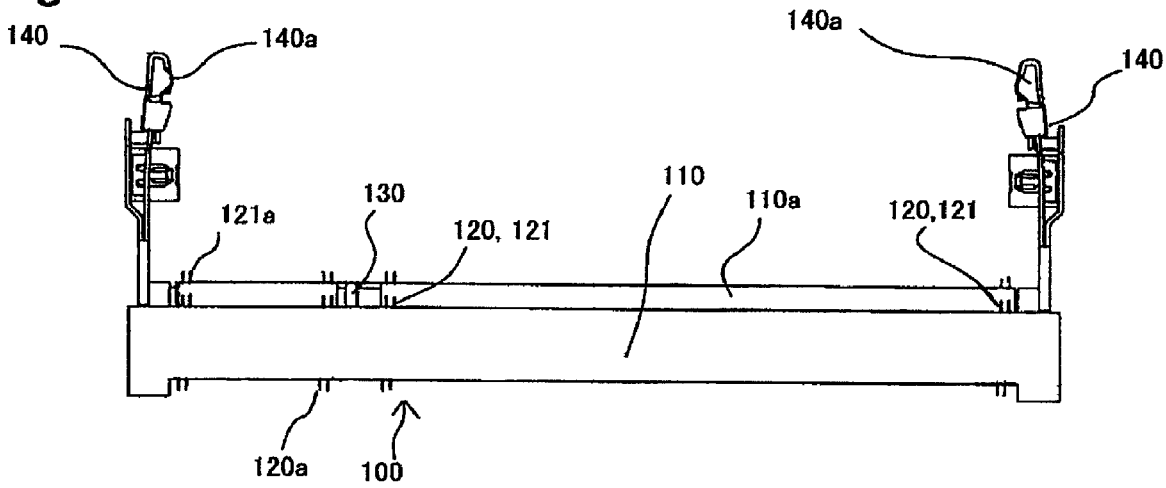
FIG. 5 is a top view of the socket 100 in an embodiment of the electrical connector of the present invention.

FIGS. 4A and 4B are cross-sectional views showing the socket 100 in a cross-section perpendicular to the arrayed direction of the upper and lower contacts 120, 121. FIG. 4A shows a cross-section at the location where the lower contact 121 at which an elastic arm is located is visible at the bottom side of the inserted small circuit board 10, and FIG. 4B shows a cross-section at the location where the upper contact 120 at which an elastic arm is located becomes visible at the top side of the inserted small circuit board 10. FIG. 5 is a plan view of the socket 100.

The small circuit board 10 indicated by the broken line in FIG. 4A shows the state in which one edge is inserted obliquely from above into the slot 110*a* and the angle is the above-mentioned maximum angle θ1. When the small circuit board 10 is inserted into the slot 110*a*, the plurality of electrical contacts formed on the upper and lower surfaces of the edge of the small circuit board 10 touch the respective plurality of upper and lower contacts 120 and 121. The upper and lower contacts 120 and 121 are press-fit into the insulative housing 110 and secured, and both contacts have an elastic arm capable of elastic displacement while continuing to touch the electrical contacts of the small circuit board 10. In this state, because the width of the notch 13 of the small circuit board 10 is larger than the thickness of the lower portion 130*b* of the positioning protrusion 130, and smaller than the thickness of the upper portion 130*a*, a gap occurs along the width between the notch 13 and the lower portion 130*b* of the positioning protrusion 130 fitted therein.

On the other hand, the small circuit board 10 indicated by the solid line in FIG. 4A shows the state in which one edge is inserted into the slot 110*a* and then the other edge is raised up in the direction indicated by the arrow A. In this state, the notch 13 is fitted into the tapered middle portion 130*c* of the positioning protrusion 130, and the small circuit board 10 is already positioned at the predetermined acceptance position. In other words, once the angle θ of the small circuit board 10, one edge thereof being inserted into the slot 110*a*, is increased to an angle greater than the above-mentioned maximum angle θ1, even if positional shifting occurs between the center of each electrical contact 12 and the center of the corresponding contact 520, the notch 13 becomes centered while sliding along the middle portion 130*c* of the positioning protrusion 130 having a tapered shape with continuously increasing thickness from the lower portion 130*b* toward the upper portion 130*a* and having left-right symmetry. Next, by pushing downward, in the direction indicated by the arrow B in the drawing, on the other edge of the small circuit board 10 positioned at the desired position along its width, and opposing the elasticity of the upper and lower contacts 120 and 121 until the small circuit board 10 becomes parallel with the motherboard, a state is obtained in which the electrical contacts 12 and the upper and lower contacts 120 and 121 touch elastically. In this state, as shown in FIG. 5, the small circuit board 10 is secured supportably on both side edges by inward facing tabs 140*a* on elastic support arms 140 constituting a pair of supports disposed in opposing positions on either side of the insulative housing 110.

With the above-described socket 100 that is an embodiment of the electrical connector of the present invention, even if there is variation in the width of the slit-shaped notch 13 of the small circuit board 10 and/or the width of the rib-shaped positioning protrusion 130, the width of the notch 13 and the width of some portion of the positioning protrusion 130 will surely match at some insertion angle by manipulating the angle of insertion of the small circuit board 10 into the slot 110*a*. Accordingly, even if the width of the notch 13 of the small circuit board 10 to be connected to the socket 100 varies within a fixed range, the plurality of electrical contacts 12 of the small circuit board 10 and the plurality of upper and lower contacts 120 and 121 of the connector 100 can connect to each other correctly.

Next, a second embodiment of an electrical connector of the present invention is described below with reference to FIG. 6. In the second embodiment, the electrical connector 100' can have the same configuration as the socket 100, with the exception of a positioning protrusion 230 for regulating the acceptance position of the small circuit board 10 inserted into a slot of the insulative housing, and that differs in shape from the shape of the positioning protrusion 130 of the socket 100 exemplified as the first embodiment. Therefore, only the positioning protrusion is described below; other parts are assigned the same reference numerals as the corresponding parts of the socket 100, and their descriptions are omitted.

Figure 6:
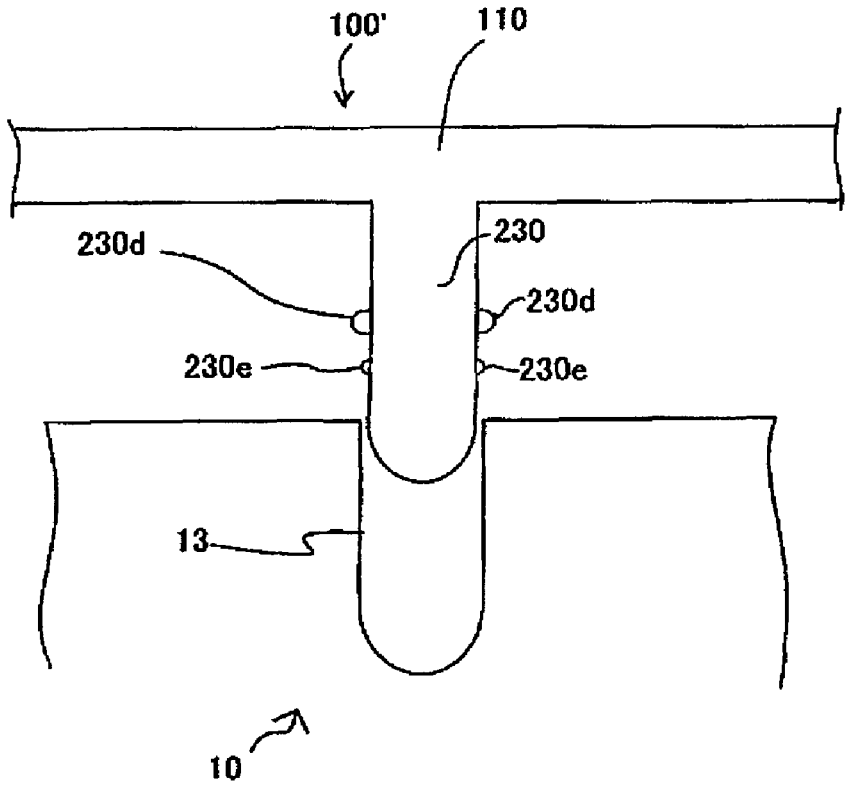
FIG. 6 is a plan view that shows schematically the positioning protrusion 230 in another embodiment of the electrical connector of the present invention.
Figure 7A:
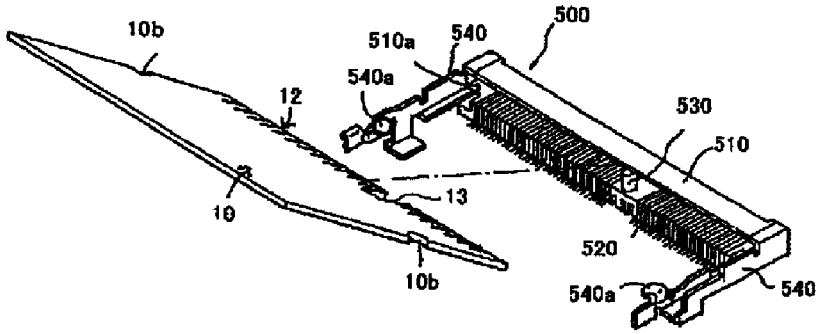
Fig. 7A Prior Art
FIG. 7A is a perspective exploded view of the small circuit board and the conventional socket.
Figure 7B:
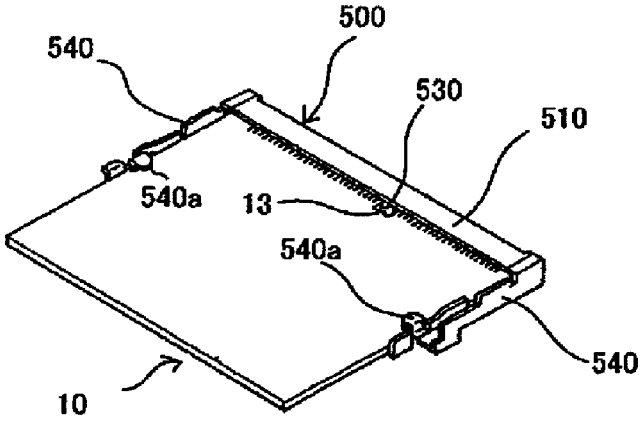
Fig. 7B Prior Art
FIG. 7B is a perspective view of the conventional socket of Prior Art FIG. 7A showing the state in which the small circuit board 10 is inserted into the slot of the socket and is held securely by support arms.
Figure 8:
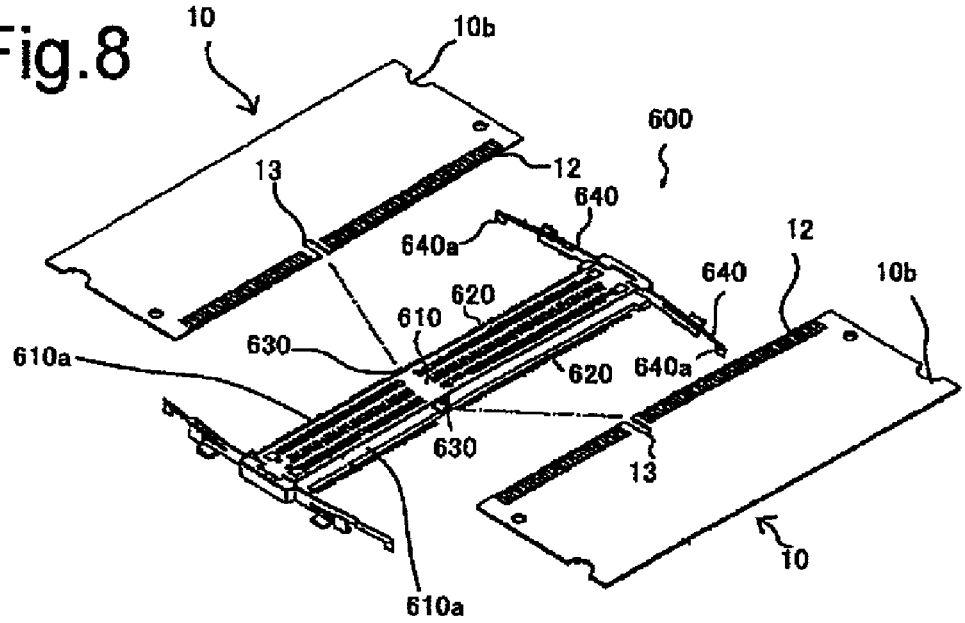
Prior Art Fig.8
FIG. 8 is a perspective view showing another example of the configuration of a conventional socket.
Figure 9:
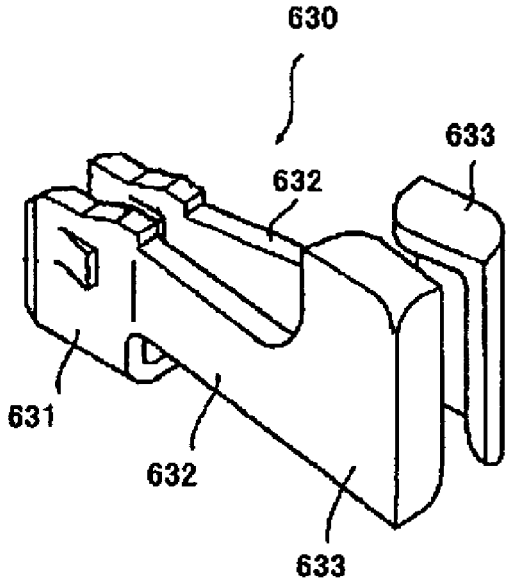
Prior Art Fig.9
FIG. 9 is a perspective view showing an elastic member mounted onto the positioning protrusion of the conventional socket shown in FIG. 8; and Prior Art
Figure 10:
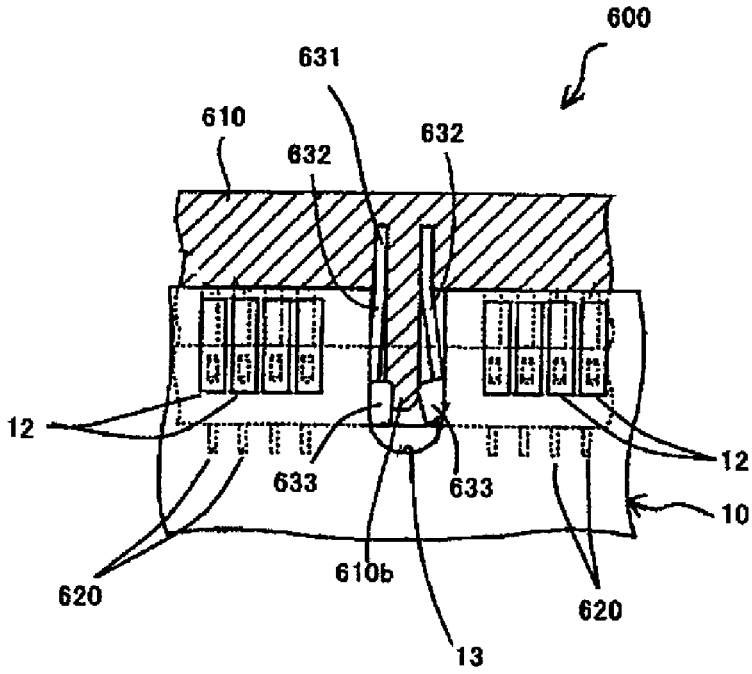
Prior Art Fig.10
FIG. 10 is a plan view showing schematically the condition wherein the acceptance position of the small circuit board is regulated by the positioning protrusion shown in FIG. 9, onto which an elastic member has been mounted.

FIG. 6 is a planar view that shows schematically the positioning protrusion 230 of the present embodiment and the engaging notch 13 of the small circuit board 10.

The positioning protrusion 230, protruding towards the insertion of the small circuit board 10, is a rib-shaped part integrally formed on the slot 110*a* of the insulative housing 110. Positioning protrusion 230 has a uniform thickness from top to bottom, and small protrusions 230*d* and 230*e* are formed with left-right symmetry on either side thereof.

The small protrusions 230*d* and 230*e* are formed along an area corresponding to the range from the middle portion 130*c* to the upper portion 130*a* of the positioning protrusion 130 in the first embodiment, and are formed as oblong shapes, extending vertically so as to engage the notch 13 of the small circuit board 10 inserted obliquely from above into the slot 110*a*.

In the case where the width of the notch 13 of the small circuit board 10 inserted into the slot 110*a* is approximately equal to the thickness of the positioning protrusion 230, the small circuit board 10 inserts into the slot 110*a* in a manner (at a relatively small angle with respect to the horizontal, and at a position corresponding to the lower portion 130*b* of the positioning protrusion 130 of the first embodiment described above) such that the notch 13 and the small protrusions 230*d* and 230*e* do not interfere with each another. In this case, the acceptance position of the small circuit board 10 is regulated by the lower portion of the positioning protrusion 230 that fits into the notch 13.

On the other hand, in the case where the width of the notch 13 of the small circuit board 10 inserted into the slot 110*a* is larger than the thickness of the positioning protrusion 230, the small circuit board 10 inserts into the slot 110*a* in a manner (at a relatively large angle with respect to the horizontal, and at a position corresponding to the range from the middle portion 130*c* to the upper portion 130*a* of the positioning protrusion 130 of the first embodiment described above) such that the notch 13 and the larger upper protrusions 230*d* or smaller lower protrusions 230*e* interfere with each other.

The upper and lower protrusions 230*d* and 230*e* are formed with increasingly taller heights such that upper protrusion 230*d* is taller than lower protrusion 230*e*, so that when the positioning protrusion 230 is inserted into the notch 13, even if the small second protrusion 230*e* does not contact the inner sidewall of the notch 13, the later inserted upper protrusion 230*d* will contact the inner sidewall of the notch 13. The small protrusions are formed so as to compress when press-fit against the inner wall of the notch 13, so that a gap does not occur between the positioning protrusion 230 and the notch 13. In this manner, at least one of the upper and lower protrusions 230*d* and 230*e* formed symmetrically on both sides of the positioning protrusion 230 will contact the inner wall of the notch 13, and thus, even if positional shifting occurs between the center of each electrical contact 12 and the center of the corresponding upper contact 120, the notch 13 is centered and the acceptance position of the small circuit board 10 is regulated.

In the above-described second embodiment of an electrical connector of the present invention, the number of small protrusions provided on each side of the positioning protrusion 230 is not limited to two. Moreover, as long as the heights of the small protrusions increase sequentially as viewed from the small circuit board 10 inserted into the slot 110*a*, the small protrusions may be of any height, within a range that does not exceed the maximum width of the notch 13. In other words, the tip of the rib-shaped positioning protrusion 230 and the small protrusions provided on both sides thereof should be selected appropriately so as to guide smoothly the notch 13 of the small circuit board 10.

In the example above, the socket 100 (100') that is an embodiment of the electrical connector of the present invention has one-hundred of each upper and lower contacts 120 and 121 arranged vertically in an alternating array along the width of the insulative housing 110. In this case, the center-to-center distance (pitch) between adjacent contacts is 0.6 mm, for example. Usually, the allowable dimensional tolerance of the width of the notch 13 of the small circuit board 10 is approximately 1 mm, but the allowable shift in the acceptance position along the width of the socket 100 is approximately 0.25 mm, maximum. Accordingly, the socket 100 of the present invention enables the relative positional shift between the electrical contacts 12 of the small circuit board 10 and the upper and lower contacts 120 and 121 to be controlled to an allowable level.

In the above explanation, only an example of a socket-type electrical connector was described, but the present invention is not limited to this example, and the present invention is widely applicable to electrical connectors that accept and connect electrically to an edge of a printed circuit board or the like.

What is claimed is:

1. An electrical connector for accepting an edge of a circuit board having a notch and a plurality of circuit board electrical contacts disposed on the edge, the electrical connector comprising:

an insulative housing that accepts the edge of the circuit board;

a positioning protrusion integrally formed with the insulative housing, the positioning protrusion being at least partially receivable within the notch of the edge of the circuit board; and a plurality of contacts that are carried by the insulative housing and contact the circuit board electrical contacts;

wherein the positioning protrusion comprises a lower portion that is less than or the same thickness as a width of the notch, an upper portion that is thicker than the lower portion and the width of the notch, and a middle portion connecting the upper portion and lower portion, and the middle portion having a thickness that changes symmetrically whereby the maximum thickness of the middle portion is larger than the thickness of the upper portion.

2. The electrical connector according to claim 1, the electrical connector further comprising:

a biased support arm for retaining the circuit board so that the edge of the circuit board is retained within the electrical connector.

3. The electrical connector according to claim 1, wherein the positioning protrusion extends from a top surface of the insulative housing to a bottom of the insulative housing.

4. The electrical connector according to claim 3, wherein the positioning protrusion extends in a nonlinear fashion.

5. The electrical connector according to claim 3, wherein the positioning protrusion extends in an arc.

6. An electrical connector for accepting an edge of a circuit board having a notch and a plurality of circuit board electrical contacts disposed on the edge, the electrical connector comprising:

an insulative housing that accepts the edge of the circuit board;

a positioning protrusion integrally formed with the insulative housing and extending from the insulative housing and at least partially receivable within the notch of the edge of the circuit board;

the positioning protrusion extends from a top surface of the insulative housing to a bottom of the insulative housing; and a plurality of contacts that are carried by the insulative housing and contact the circuit board electrical contacts;

wherein the positioning protrusion comprises a lower protrusion extending from a left or a right side of the positioning protrusion and an upper protrusion extending from the left or right side of the positioning protrusion, wherein the upper protrusion extends further from the positioning protrusion than the lower protrusion, and wherein the upper protrusion is located closer to the insulative housing than the lower protrusion.

7. The electrical connector according to claim 6, wherein the upper protrusion and lower protrusion extend away from the positioning protrusion so that at least one of the upper protrusion and the lower protrusion contact a face of the notch.

8. The electrical connector according to claim 6, the electrical connector further comprising:

a biased support arm for retaining the circuit board so that the edge of the circuit board is retained within the electrical connector.

9. The electrical connector according to claim 6, wherein the positioning protrusion extends in a nonlinear fashion.

10. The electrical connector according to claim 6, wherein the positioning protrusion extends in an arc.

* * * * *